United States Patent [19]

Armstrong

[11] Patent Number: 4,639,215

[45] Date of Patent: Jan. 27, 1987

[54] GAS BURNER

[75] Inventor: Richard J. Armstrong, Toronto, Canada

[73] Assignee: Bernard Marks and Company Limited, Toronto, Canada

[21] Appl. No.: 399,272

[22] Filed: Jul. 19, 1982

Related U.S. Application Data

[63] Continuation-in-part of Ser. No. 117,383, Feb. 1, 1980, abandoned.

[51] Int. Cl.[4] ..... F23D 14/62

[52] U.S. Cl. ..... 431/354; 431/353; 239/399

[58] Field of Search ..... 431/344, 353, 354, 355; 239/399

[56] References Cited

U.S. PATENT DOCUMENTS

| | | | |
|---|---|---|---|
| 3,510,238 | 5/1970 | Biber | 431/350 |
| 3,844,707 | 10/1974 | Wormser | 431/353 |
| 4,013,395 | 3/1977 | Wormser | 431/353 |
| 4,255,124 | 3/1981 | Baranowski | 431/353 |

*Primary Examiner*—Carroll B. Dority, Jr.

*Attorney, Agent, or Firm*—Fetherstonhaugh & Co.

[57] ABSTRACT

The invention is a burner for combustible gases such as a propane/air burner. It is concerned with an improvement to the flame stabilizer in such a burner. The flame stabilizer is unique in that it forms the gas flow into two similar paths and, then, reunites the paths so that they interface and form a vortex sheet at their interface that, in turn, forms a vortex downstream of the stabilizer. The vortex sheet formation protects the stabilizer from the heat of the burned gases and provides very efficient stabilization for the flame.

4 Claims, 12 Drawing Figures

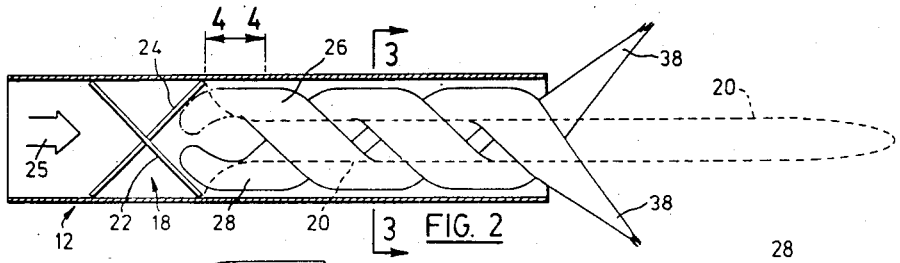
FIG. 2
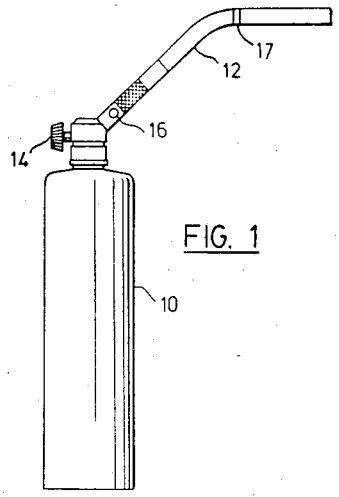
FIG. 1
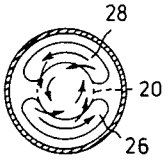
FIG. 3
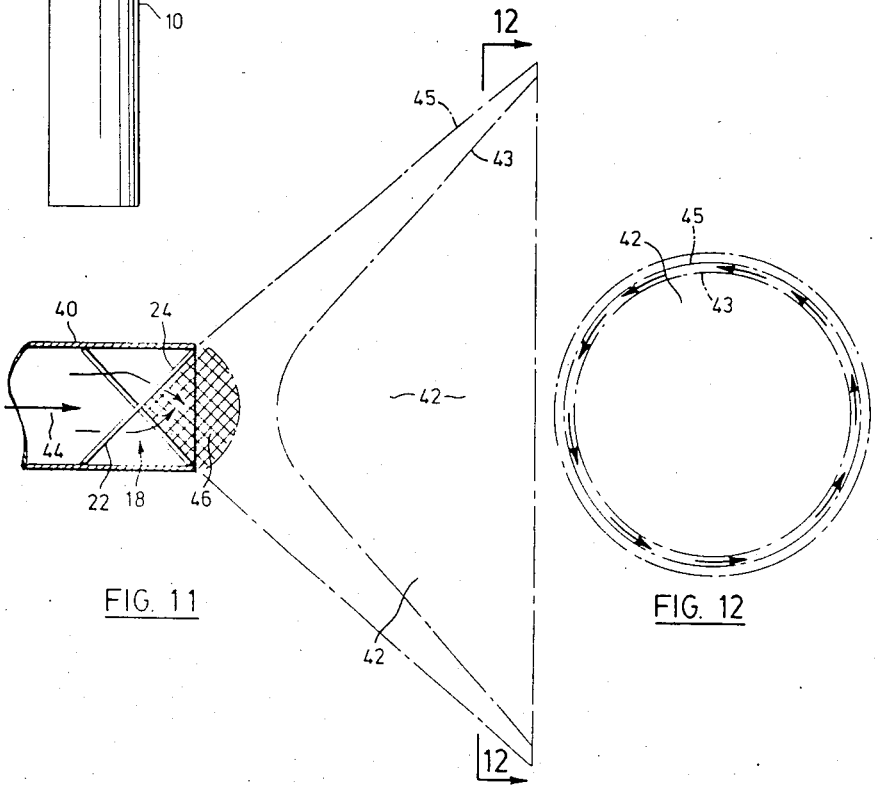
FIG. 11
FIG. 12

12
20
10
9
8
7
6
5
30
22
24
32
25
26
28
34
36

GAS BURNER

This invention relates generally to burners for pressurized combustible gases such as a propane/air brazing torch and is a continuation-in-part of application Ser. No. 117,383 filed on Feb. 1, 1980, now abandoned.

More particularly, the invention relates to an improvement to a flame stabilizer for such burners.

When burning pressurized gases within a duct, it is necessary to provide a flame stabilizer. Otherwise, the flame will blow out beyond the duct that conducts the burning gases and become extinguished.

There are many known designs for flame stabilizers in gas burners, but to the best of applicant's knowledge all stabilizers of the prior art rely upon bluff body action, i.e. they consist of a structure located in the stream of gas flow that forms the gas flow into a turbulent wake that involves recirculation of the hot burning gases which, in turn, ignite freshly supplied gases at the boundary between the two.

Bluff body stabilizers get very hot in operation because the burning gases in the swirling recirculation zone that they create extend upstream of the stabilizer. The temperature of the stabilizer approaches the temperature of the burnt gases in the recirculation zone and must be made of heat resistant materials. In this respect, U.S. Pat. No. 4,255,124 to Baranowski is an example of a gas burner with a stabilizer of the bluff body type. It will be noted that at about column 4, line 67 there is reference to the requirement that the stabilizer be made from high temperature material. To applicant's personal knowledge, flame stabilizers on brazing torches made on similar principles to those described in Wormser U.S. Pat. No. 4,013,395 must also be made from expensive heat resistant alloys. This is universal practice with bluff body stabilizers.

A very common use for a gas burner according to this invention is a brazing torch. These torches are relatively inexpensive to manufacture, and if the flame stabilizer must be made of a heat resistant alloy, the cost of the stabilizer is a significant item in the cost of the unit as a whole. The high materials cost of the stabilizer is avoided with this invention.

The gas burner of this invention has a stabilizer of a unique construction that operates on an entirely different principle from the bluff body principle, creates a different type of turbulence downstream of the stabilizer, operates at a low temperature, has a relatively low resistance to gas flow through the burner, and has a high effective turn-down ratio.

The stabilizer of this invention has baffles arranaged to separate the gas flow into two paths and then reunite them as they flow in opposite directions at an interface to form a vortex sheet by viscous shear that is attached to and downstream of the stabilizer and that subsequently develops into a vortex tube still further downstream from the stabilizer. The stabilizer does not get hot because the vortex at the stabilizer is in the form of a sheet of very close to zero thickness. This is too small for the burning, recirculating gases of the vortex to enter with the result that the flame of recirculated gases downstream of the stabilizer never touches the stabilizer. The stabilizer in the case of this invention can be made of mild steel, plastics material or even cardboard without danger of being destroyed by the heat of the flame of the burner.

At the same time the flame stabilizer of this invention presents a low resistance to flow through the burner with the result that for a given size the unit has a large through-put and can generate a correspondingly higher brazing temperature. Moreover, the pattern of the gases created by this invention downstream of the stabilizer remains relatively cool at the outer portions in comparison to the turbulent wake type of pattern created by a bluff surface stabilizer of the prior art so that the combustion tube in a brazing torch according to this invention does not become as hot to the touch as it does with a torch that has a conventional bluff body stabilizer.

The gas burner of the invention has a novel flame stabilizer that operates on a different principle to provide a vortex with a recirculation zone downstream of the stabilizer to achieve the advantages above noted.

With the advantages and objectives above noted in view a burner for combustible gases according to this invention has a duct for the flow of pressurized combustible mixture, a vortex sheet generator mounted in said duct, said vortex sheet generator having two baffles, each baffle defining a separate path through the generator adapted to conduct substantially equal portions of the total flow of combustion gas through the generator, each of said baffles inclining in an opposite direction longitudinally of the duct and having a straight vortex sheet edge, the vortex sheet edge of the two baffles meeting in the central area of the duct to make a V-configuration opening in the downstream direction of the duct, the vortex sheet edges of the two baffles being contained in a common plane that extends along the longitudinal axis of the duct, whereby gas from each path through said generator emerging past its respective vortex sheet edge interfaces with gas from the other path emerging from its respective vortex sheet edge in an opposed direction to form a vortex sheet by viscous shear that is attached to and downstream of said vortex sheet edges and that developes into a vortex tube still further downstream of the vortex sheet edges.

The invention will be clearly understood after reference to the following detailed specification read in conjunction with the drawings.

In the drawings:

FIG. 1 is a general illustration of a propane brazing torch;

FIG. 2 is a sectional illustration of the free end portion of the duct of the torch of FIG. 1 downstream of the stabilizer;

FIG. 3 is a sectional view at the line 3—3 of FIG. 2;

FIG. 11 is an illustration of the free end of a duct with the flame stabilizer of the invention located at its free end; and FIG. 12 is a view along the line 12—12 of FIG. 11.

Figures 4, 5, 6, 7, 8, 9, 10:
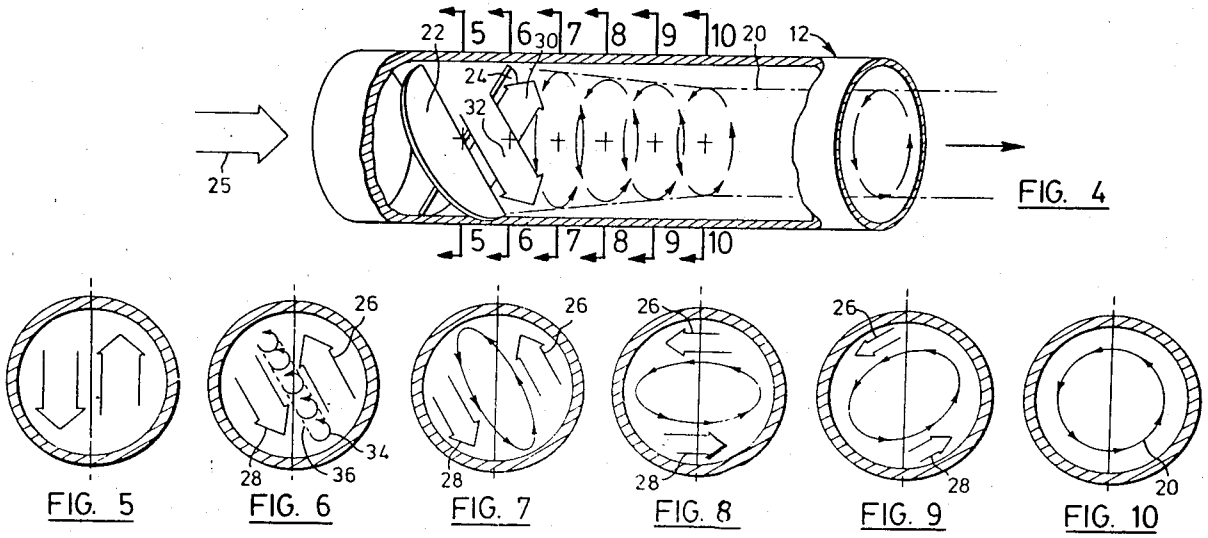
FIG. 4 is an illustration of a cut-away portion of the duct between the planes noted by the arrows 4—4 of FIG. 2 illustrating the manner in which the gases emerge from the stabilizer.
FIGS. 5 to 10 are sectional illustrations illustrating the manner in which the stabilizer forms a vortex sheet from the gases, the flame attaches to the vortex sheet, and the vortex sheet coalesces into a vortex tube as it is fed by the products of the combustion of the spiral shaped burning streams of gases within the duct.

This invention will be described as it relates to a brazing torch of the type that is fueled by a combustible mixture of air and propane or the like. It will be understood, however, that it has applications to gas burners other than the type specifically described herein.

In a brazing torch, a hot flame is desirable because the ultimate utility of the torch depends upon the amount of heat that the torch can supply to a work piece. The heat of the flame can be controlled to some extent by combustion conditions but there is a limit to what can be achieved through this expedient because the combustion temperature of a given gas under ideal conditions is fixed. This invention is not particulary concerned with the achievement of ideal combustion conditions and it assumes good conditions of combustion.

Given a brazing borch of a specific size and assuming given combustion conditions, the ability of a brazing torch to heat the work piece depends upon the flow rate of combustible gases through the combustion duct of the torch. As one increased the flow rate of gases through the torch, the work piece will become hotter.

The heat of the flame in a conventional brazing torch is contained in the recirculation zone of the flame. The recirculation zone contains the heat of the burned gases.

Conventional air/propane brazing torches have a flame stabilizer that incorporates a bluff body. The bluff body functions to create a recirculation zone downstream thereof. In operation, these bluff bodies cause turbulence and back and forth motion of the gas particles at a bluff body. There is an inherent loss of flow energy caused by the recirculation of the gases around the bluff body as it sets up the recirculation zone around which combustion of the gas is stabilized.

In the case of the gas burner described herein, there is no bluff body in the stabilizer with its attendant inefficient recirculation of gases, but rather there is a baffle structure that divides the stream of combustible gases in the duct and then reunites it over an interface, the gas particles at the interface having opposed directions adjacent the interface so as to develop a vortex sheet that continues development and growth into a vortex tube which contains the burned gases of the flame downstream of the baffles. The general direction of rotation of the particles that enter into the vortex sheet that is formed at the interface of the two streams is the same as the general direction of rotation of the particles in the vortex tube that is formed so that there is very little, if any, energy loss in the setting up of the vortex tube that contains hot gases of combustion.

As a result of this efficient setting up of a vortex tube the resistance to gas flow through the duct is reduced and for a given size torch, there is an increased flow rate of gases through the duct. This results in a more effective brazing torch by reason of the greater guantity of gas that is burned in the tube.

The flame is held on the vortex sheet and burns around the vortex sheet and vortex tube that forms downstream of the stabilizer. Combustion takes place downstream of the stabilizer and spaced inwardly of the duct walls. Thus, both the stabilizer and the duct walls tend to be cooler than the combustion temperature. FIG. 1 is an illustration of a brazing torch. It comprises a hand held container of liquid propane gas 10 upon which is mounted a gas duct 12. Flow of gas from the container 10 through the duct is controlled by means of a valve 14. Air is mixed with the propane gas as it passes the air admitting port 16. The combustible mixture of air and propane proceeds through the duct to the location of a flame stabilizer indicated at 17 on FIG. 1 and burns within the duct downstream of the flame stabilizer, generally indicated by numeral 18 on FIGS. 2 and 4 and proceeds from the open end of the duct to a work piece. Container 10 contains liquid propane which is permitted to vaporize by communication to atmosphere through valve 14 whereby to form the pressurized gas flow. This is standard practice.

The combustible gases burn downstream of the flame stabilizer in the duct of the brazing torch. The flame stabilizer forms a vortex tube 20 around which the gases burn and in which the hot products of combustion of the flame are contained. The heat from the flame is derived from the heat of the vortex tube and it will be apparent that as the quantity of the burning gases passing through the duct increases the quantity of heat contained in the vortex tube will increase. It is, therefore, important that as much gas be passed through the duct 12 as possible (assuming optimum burning conditions).

The flame stabilizer herein described is thought to be of improved efficiency and capable of passing more gas through the duct 12 than flame stabilizers previously known.

FIGS. 2 and 4 are illustrations of the free end of the duct and illustrate a flame stabilizer that comprises baffles 22 and 24 which are designed to divide the flow of pressurized combustible gases as it exists upstream of the stabilizer and generally indicated by the arrow 25 into two streams, the gas that strikes baffle 22 becoming one stream 26 and the gas that strikes baffle 24 becoming the other stream 28. These views are illustrative only and not necessarily proportional to actual conditions in the tube. In practice the two streams should be as near equal as normal production tolerance will allow. If one stream is much larger than the other it will overpower the lesser stream and a weak vortex will result. This causes a ragged flame and poor heating.

These are spiral shaped streams downstream of the baffles 22 and 24 formed by the combined action of the baffles and duct walls and proceed under the influence of the gas pressure.

The two streams 26 and 28 unite with a shearing action over an interface very close to the edge of the baffles where the edges of the two baffles form a V-opening in the downstream direction of the duct as they each travel around the downstream edge of their respective baffle. The edges of the baffles that form the V-formation are in a common plane that lies on the longitudinal axis of the duct.

The general direction of gas particle movement at this interface for a gas from stream 26 is indicated by the arrow 30 on FIG. 4 and the general direction of gas movement from stream 28 at this interface is indicated by numeral 32. It will be seen that movement of gas particles in the two streams at the interface is opposed in direction with the result that a vortex sheet is formed between the streams in the space in front of the V-configured edges downstream of the baffles. The V-configured edges are often referred to herein as vortex sheet edges.

At this interface, the gas streams 26 and 28 flow with relative movement between them. The surface separating them at the location where they get into contact can be considered as a surface of discontinuity. Across it, the flow changes in direction. As a result of viscous friction, this surface is unstable and quickly breaks up into a large number of eddies or vorticies 34 which form a vortex sheet 36 between the streams.

The vortex sheet 36 is formed along the combined vortex sheet edge of each of the baffles 22 and 24 at the V on the downstream side.

FIG. 6 is a sectional illustration of the vortex sheet 36 shortly after its formation and of the transverse component of direction of the gas streams 26 and 28 on each side of the vortex sheet. It will be noted that the component of direction transversely of the duct of the flow in the gas streams 26 and 28 and in the vorticies 34 that constitute the vortex sheet 36 is the same where they interface.

As illustrated in FIG. 2, the flame commences to burn at the vortex sheet and the vortex sheet is attached to the vortex sheet edges of the baffles. Numerals 26 and 28 illustrate the paths of the burning gas flows as they proceed down the duct 12. Burning commences slightly downstream of the edges of the baffles 22 and 24 and at the vortex sheet. The flame is stabilized along the vortex sheet. It does not extend back to the baffles. This is of significance because the baffles are not directly in contact with the burning gases. In all flame stabilizers of the prior art, the burning extends back to and is in contact with the flame stabilizer with the result that the stabilizer becomes very hot and must be made from heat resistance metal. With the stabilizer of this invention, the baffles can be made from mild steel because the temperatures that they reach in practice can be withstood by mild steel. The cost of manufacturing a high temperature steel flame stabilizer is very much greater than the cost of manufacturing a simple baffle from mild steel as required by the present invention.

With the bluff body stabilizers of the prior art, there is a recirculation zone downstream of the stabilizer. The burning gases are continually recirculated in the recirculation zone towards the bluff body and are in contact with it so that the bluff body stabilizer is subjected to the heat of the flame. This is the reason that with the stabilizers of the prior art construction must be of a heat resistant material.

FIGS. 7 to 10 show the manner in which the vortex sheet 36 formed between the two streams of gas 26 and 28 coalesces firstly into an eliptical shaped vortex tube and, then, finally into a round forced vortex tube as the streams of gas burn as they flow through the tube. The arrows indicate the direction of motion of gas in the vortex and in the unburned gas streams.

Burning in the flowing gases takes place at the boundary between the vortex sheet or tube as the case may be and the streams of gas 26 and 28 and the hot products of combustion fall into the vortex tube. A hot vortex tube emerges from the end of the duct 12 that contains the hot products of combustion of the combustible gases that have burned in the tube. It is this vortex tube that, when applied to a piece supplies the heat for the brazing operation.

The gases that are unburned in the duct continue to spiral around the vortex tube and they emerge as a brush flame indicated in FIG. 2 as at 38.

The rotation of the vortex tube that contains the hot gases of combustion of the gas is, as noted above, of the same direction as the rotation of the vortex sheet. This is of significance because there is no continuous back and forth motion of the particles as the vortex is formed. The result is the formation of a forced vortex tube without the inefficient continuously back and forth turbulent motion of particles that is encountered with the bluff body method of stabilizing a flame. In result, there is a minimum of flow energy loss in the setting up and maintenance of the vortex tube and it is possible to pass a greater amount of gas through a given duct and, therefore, achieve a greater energy flow with greater temperatures to the work piece. Thus, as noted above one can with a given torch size pass more gas and achieve a higher brazing temperature.

In use, a propane/air torch according to this invention is used in the same manner as a conventional propane/air torch. Propane is released by opening valve 14. It flows through the duct 12 and is ignited by applying spark at the open end of the duct. The pressurized gas/air mixture burns downstream of the flame stabilizer as described above.

The intensity of the burning can be controlled by varying the opening of the valve 14 over a wide range and, for reasons indicated above, the heat supplied to a work piece by a maximum intensity flame is greater than with conventional burners.

As indicated, the invention has been described associated with a brazing torch and its use in a brazing torch is very important. It, however, has wider application and it is not intended that the flame stabilizer as described should be limited in application to a brazing torch wherein the gas is substantially burned within a duct. FIG. 11 illustrates a burner with the stabilizer of the same design as illustrated in FIG. 4 in a duct 40 at the free end thereof. The baffles 22 and 24 of the stabilizer are located in the flow of combustible mixture that is moving in the direction of arrow 44 and form a vortex sheet along the downstream vortex edges at the V formed by the baffles as explained above. In this case, the flames of the burning divided gas flow attach themselves to the vortex sheet which expands into a vortex cone of annular cross section 43. Here again, the gases burn at the outer face of the vortex cone to form a stable flame 45 around the vortex cone that is also annular in cross-section and extends all around the vortex cone. The vortex sheet is indicated by the numeral 46. It quickly develops into a shallow vortex 43 with the gases thereof travelling in the direction of the arrows. The space 42 inside the vortex cone 43 is principally air. The principle of operation is the same. The vortex sheet generator causes the gases from the two streams to come together along an interface at the edges of the baffles contained by the downstream V formation as in the first embodiment described.

The importance of the free standing embodiment of the invention as illustrated in FIG. 11 is derived from the nature of the vortex that is formed and the stable flame that results over the wide turn down range around this cone relatively close to the free end of the duct.

With conventional duct flame stabilizers, the burning gas tends to flow from a duct at a substantial rate of speed and become extinguished. They are not forced into a vortex. The amount of gas that can be burned is relativey small because the orifice must be kept small to ensure that the gas will burn within a reasonable distance from the duct and not become extinguished. The result is that, to burn a given amount of gas with a conventional free standing burner and stabilizer, a larger number of ports and stabilizers must be used.

These burner constructions of the prior art are relatively expensive. With this invention, one can burn a relatively large amount of gas through one larger burner duct with one orifice. The cost is very much less.

The baffles 22 and 24 can be formed from a single piece of eliptically-shaped mild steel, cut along its principal axis from each end towards but short of midway on the axis. The two sections, thus, delineated are twisted relatively to each other to the shape shown in the drawings which is a push fit with the inside wall of the duct. It is preferably fixed in location in the duct by swaging the duct inwardly at each end as illustrated at 17 in FIG. 1. Almost any material that is structurally strong enough will do, however. Plastics materials are contemplated. A prototype has been operated using cardboard.

The two baffles preferably make an angle of about 90 degrees at the V but the invention will work at other angles. It is only necessary that a vortex sheet will form and the invention has worked with contained angles of between 120 degrees and 60 degrees. Selection of angle is a matter of skill in the art.

What I claim as my invention is:

1. A burner for combustible gases comprises:

a duct for the flow of pressurized combustible mixture;

a vortex sheet generator mounted in said duct;

said vortex sheet generator having two baffles, each baffle defining a separate path through the generator adapted to conduct substantially equal portions of the total flow of combustion gas through the generator;

each of said baffles inclining in an opposite direction longitudinally of the duct and having a straight vortex sheet edge;

the vortex sheet edge of the two baffles meeting in the central area of the duct to make a V-configuration opening in the downstream direction of the duct;

the vortex sheet edges of the two baffles being contained in a common plane that extends along the longitudinal axis of the duct, whereby gas from each path through said generator emerging past its respective vortex sheet edge interfaces with gas from the other path emerging from its respective vortex sheet edge in an opposed direction to form a vortex sheet by viscous shear that is attached to and downstream of said vortex sheet edges and that developes into a vortex tube still further downstream of the vortex sheet edges.

2. In a burner for combustible gases as claimed in claim 1 wherein said vortex sheet generator is mounted in said duct upstream of the free end thereof whereby gas from said paths will burn substantially in said duct.

3. In a burner for combustible gases as claimed in claim 1 in which said vortex sheet edges make a V-formation as aforesaid with a contained angle of about 90 degrees.

4. In a burner for combustible gases as claimed in claim 2 in which said vortex sheet edges make a V-formation as aforesaid with a contained angle of about 90 degrees.

* * * * *